United States Patent [19]

Holoubek

[11] Patent Number: 4,776,494

[45] Date of Patent: Oct. 11, 1988

[54] UNIT DOSE DISPENSING COLLAPSIBLE TUBE ADAPTED TO DISPENSE A VISCIOUS LIQUID THEREFROM

[75] Inventor: George H. Holoubek, Muscatine, Iowa

[73] Assignee: Wheeling Stamping Company, Wheeling, W. Va.

[21] Appl. No.: 96,719

[22] Filed: Sep. 14, 1987

[51] Int. Cl.[4] ..... B65D 37/00

[52] U.S. Cl. ..... 222/207; 222/212; 222/425; 222/531

[58] Field of Search ..... 222/108–109, 222/206–207, 212, 215, 424.5, 425, 452, 454, 457, 531–532, 534, 536, 545, 556, 107

[56] References Cited

U.S. PATENT DOCUMENTS

| | | | |
|---|---|---|---|
| 1,933,448 | 10/1933 | Prahl | 222/454 X |
| 2,464,222 | 3/1949 | Fazekas | 222/554 |
| 2,938,653 | 5/1960 | Church et al. | 222/536 |
| 3,094,256 | 6/1963 | Ensch | 222/108 X |
| 3,251,516 | 5/1966 | Thomas | 222/536 |
| 3,366,284 | 1/1968 | Marona et al. | 222/211 |
| 3,575,324 | 4/1971 | Hazard | 222/452 |
| 4,015,756 | 4/1977 | Beck | 222/534 |
| 4,077,547 | 3/1978 | Donoghue | 222/207 |
| 4,106,673 | 3/1977 | Donoghue | 222/207 |
| 4,143,797 | 3/1979 | Reed | 222/207 |
| 4,376,495 | 3/1983 | Spatz | 222/46 |
| 4,564,129 | 1/1986 | Urban et al. | 222/207 |
| 4,607,762 | 8/1986 | Zulauf et al. | 222/48 |

FOREIGN PATENT DOCUMENTS

| | | | |
|---|---|---|---|
| 1349572 | 12/1963 | France | 222/536 |
| 2013367 | 10/1971 | Fed. Rep. of Germany | 222/532 |

*Primary Examiner*—Michael S. Huppert

*Attorney, Agent, or Firm*—Parmelee, Miller, Welsh & Kratz

[57] ABSTRACT

A unit dose dispensing collapsible tube adapted to dispense a viscous liquid therefrom includes a collapsible tube portion and a unit dose dispenser. The unit dose dispenser includes a cap member on the collapsible tube portion, and a closure element connected to the cap member. The cap member has an opening therein to provide a path of flow for the viscous liquid in the collapsible tube portion from the collapsible tube portion to the unit dose dispenser, and an indentation therein to define a unit dose-measuring section adapted to hold a unit dose of a viscous liquid. The closure element has a lower surface with a configuration complementary to the bottom surface of the unit dose-measuring section of the cap member and a passageway therethrough in fluid flow communication with the viscous liquid in the collapsible tube portion and the unit dose-measuring section. The closure element is capable of movement between an open position in which the viscous liquid flows from the collapsible tube portion through the passageway to the unit dose-measuring section of the cap member, and a closed position in which the viscous liquid is dispensed from the unit dose-measuring section of the cap member.

17 Claims, 1 Drawing Sheet

UNIT DOSE DISPENSING COLLAPSIBLE TUBE ADAPTED TO DISPENSE A VISCIOUS LIQUID THEREFROM

BACKGROUND OF THE INVENTION

This invention relates to a unit dose dispensing collapsible tube adapted to dispense a viscous liquid therefrom and, more particlarly, to a unit dose dispenser for dispensing a viscous liquid from such a collapsible tube.

Collapsible tubes are commonly used to hold viscous liquids, such as lotions, creams and medicants. One type of such tube has a dispenser mounted on the tube. The dispenser can include a cap member on the tube and a closure element connected to the cap member. The cap member can have an opening therein to provide a path of flow for the viscous liquid in the tube from the tube to the dispenser. The closure element is capable of movement between the closed position and an open position in which a passageway through the closure element is in fluid flow communication with the opening in the cap member so that the viscous liquid flows from the tube to the cap member and through the passageway in the closure element to the user. Thus, a viscous liquid is dispensed from such a tube by squeezing the tube to force the liquid from the tube through the opening in the cap member and through the passageway in the closure element.

The user of such tubes sometimes must know just how much of the contents of the tube is being dispensed at a time, particularly if the viscous liquid is medicated. This is difficult unless the tube includes an additional reservoir that is of a size to hold a unit dose of the viscous liquid. Several such dispensers for viscous liquids in collapsible tubes are available. However, they are often unwieldy and complex, as they have one mechanism to control flow from the tube to the reservoir and a separate mechanism to control the dispensing of the viscous liquid from the reservoir to the user.

A further problem associated with collapsible tubes is that often excess viscous liquid dispensed from the tube is wasted because it cannot be placed back in the tube.

Thus, it is desired to develop a unit dose dispensing collapsible tube adapted to dispense a viscous liquid therefrom.

SUMMARY OF THE INVENTION

The unit dose dispensing collapsible tube of the present invention is adapted to dispense a viscous liquid therefrom. The collapsible tube includes a collapsible tube portion adapted to hold a viscous liquid, and a unit dose dispenser. The unit dose dispenser includes a cap member on the collapsible tube portion, and a closure element connected to the cap member. The cap member has an opening therein to provide a path of flow for the viscous liquid in the collapsible tube portion from the collapsible tube portion to the unit dose dispenser, and an indentation therein to define a unit dose measuring section adapted to hold a unit dose of a viscous liquid. The closure element has a lower surface with a configuration complementary to the bottom surface of the unit dose-measuring section of the cap member, and a passageway therethrough in fluid flow communication with the viscous liquid in the collapsible tube portion and the unit dose-measuring section. The closure element is capable of movement between an open position in which the viscous liquid flows from the collapsible tube portion through the passageway to the unit dose measuring section of the cap member and a closed position in which the viscous liquid is dispensed from the unit dose-measuring section of the cap member.

A unit dose of the viscous liquid is dispensed from the unit dose dispensing collapsible tube of the invention by moving the closure element to its open position, applying pressure to the collapsible tube portion, and causing the viscous liquid to flow from the collapsible tube portion through the passageway in the closure element to the unit dose-measuring section of the cap member. When the unit dose-measuring section of the cap member is filled with a unit dose of the viscous liquid, the closure element is moved to its closed position to dispense the unit dose of the viscous liquid from the unit dose-measuring section of the cap member.

BRIEF DESCRIPTION OF THE DRAWINGS

These and other objects, features and advantages of the subject invention will become more fully apparent from the following detailed description and accompanying drawings in which.

DETAILED DESCRIPTION OF THE PREFERRED EMBODIMENTS

Figure 1:
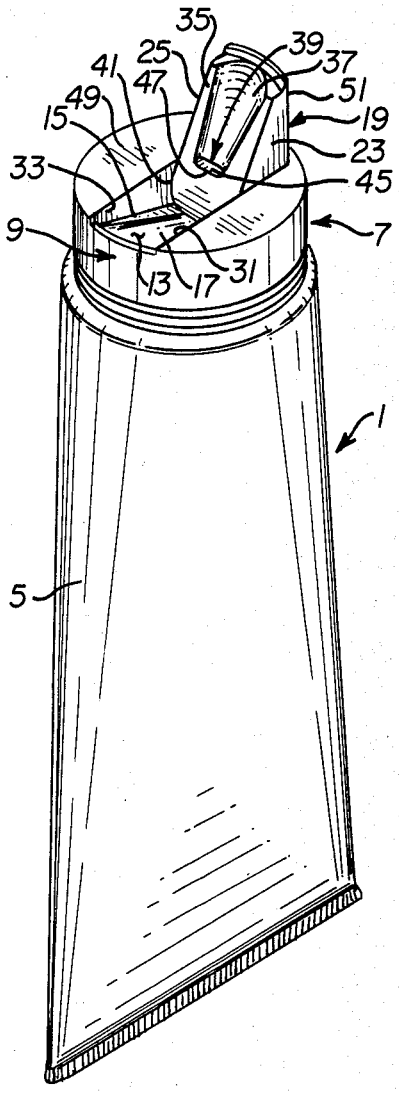
FIG. 1 is a perspective view of a unit dose dispensing collapsible tube of the present invention with the closure element in its open position.

The unit dose dispensing collapsible tube 1 of the invention is adapted to dispense a unit dose of a viscous liquid 3 (FIG. 5) therefrom. The unit dose dispensing collapsible tube 1 (FIG. 1) includes a collapsible tube portion 5 that is adapted to hold a viscous liquid 3, and a unit dose dispenser 7.

The unit dose dispenser 7 includes a cap member 9 on the collapsible tube portion 5. As shown in the Figures, the cap member 9 and the collapsible tube portion 5 form a single unit. It can be readily understood, however, that the cap member 9 and the collapsible tube portion 5 may be separate pieces which can be attached together, such as by the cap member 9 and the collapsible tube portion 5 having inner and outer complementarily threaded surfaces, respectively.

Figure 2:
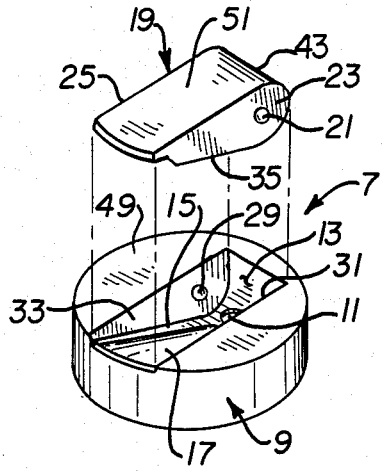
FIG. 2 is an exploded perspective view of the unit dose dispenser of FIG. 1 with the closure element in its closed position.
Figure 3:
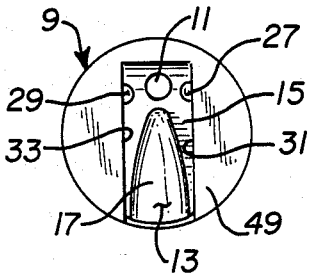
FIG. 3 is a top plan view of the cap member of FIG. 1 with the closure element removed.

The cap member 9 includes an opening 11 (FIGS. 2 and 3) from which the viscous liquid 3 flows from the collapsible tube portion 5 into the unit dose dispenser 7. The cap member 9 further includes an indentation therein to define a unit dose-measuring section 13, which is of a size necessary to hold a unit dose of the viscous liquid 3. The bottom surface 15 of the unit dose-measuring section 13 preferably includes a raised convex area 17 in the center thereof.

Figure 4:
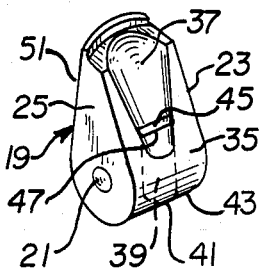
FIG. 4 is a perspective view of the closure element of FIG. 2.

The unit dose dispenser 7 further includes a closure element 19 that is connected to the cap member 9. Preferably, the closure element 19 includes a pair of notches 21 (FIGS. 2 and 4) in side surfaces 23 and 25, respectively, which receive a pair of projections 27 and 29, respectively, in the side walls 31 and 33 (FIGS. 2 and 3), respectively, of the unit dose-measuring section 13 of the cap member 9 to hingedly connect the closure element 19 to the cap member 9.

The lower surface 35 (FIGS. 1 and 4) of the closure element 19 has a configuration complementary to that of the bottom surface 15 of the unit dose-measuring section 13 of the cap member 9. Thus, preferably, the lower surface 35 of the closure element 19 includes an indented concave area 37 that is complementary to the raised area 17 of the bottom surface 15 of the unit dose-measuring section 13 of the cap member 9.

The closure element 19 has a passageway 39 (Figures 1, 4 and 5) therein, which preferably terminates at one end in an opening 41 in the end surface 43 (FIGS. 2 and 4) of the closure element 19, and in the other end, in an opening 45 (FIGS. 1, 4 and 5) in the lower surface 35 of the closure element 19, in order to provide a path of flow for the viscous liquid 3 from the collapsible tube portion 5 through the closure element 19 to the unit dose-measuring section 13 of the cap member 9. The opening 41 in the end surface 43 of the closure element 19 communicates with the opening 11 in the cap member 9. The viscous liquid 3 flows from the opening 45 in the lower surface 35 of the closure element 19 to the unit dose-measuring section 13.

The closure element 19 is capable of movement between an open position (FIGS. 1 and 5) in which the viscous liquid 3 can flow from the collapsible tube portion 5 through the opening 11 in the cap member 9, the opening 41 in the end surface 43 of the closure element 19, the passageway 39, and the opening 45 in the lower surface 35 of the closure element 19 to the unit dose-measuring section 13 of the cap member 9, and a closed position (FIGS. 2 and 6) in which the viscous liquid 3 is dispensed from the unit dose-measuring section 13 of the cap member 9.

Figure 5:
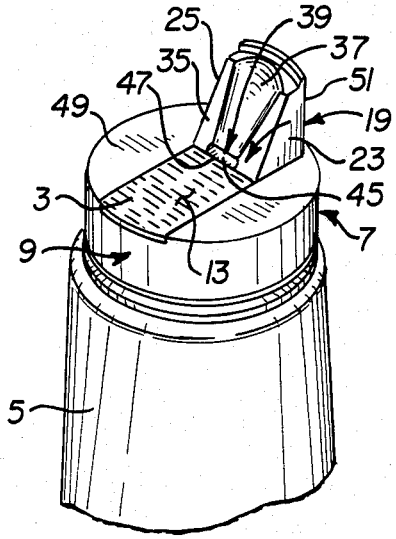
FIG. 5 is a perspective view of a part of the collapsible tube portion and the unit dose dispenser of FIG. 1 showing the unit dose-measuring section filled with a viscous liquid.

Preferably, the lowermost edge 47 of the opening 45 in the lower surface 35 of the closure element 19 is coplanar with the upper surface 49 of the cap member 9 when the closure element 19 is in its open position (FIGS. 1 and 5). Thus, if an excess of the viscous liquid 3 is forced from the collapsible tube portion 5 into the unit dose-measuring section 13 of the cap member 9, the excess viscous liquid 3 will be drawn back into the collapsible tube portion 5 through the opening 45 in the lower surface 35 of the closure element 19, the passageway 39, the opening 41 in the end surface 43 of the closure element 19, and the opening 11 in the cap member 9 as the pressure on the collapsible tube portion 5 is released (FIG. 5). More preferably, the opening 45 in the lower surface 35 of the closure element is a horizontal slit.

Figure 6:
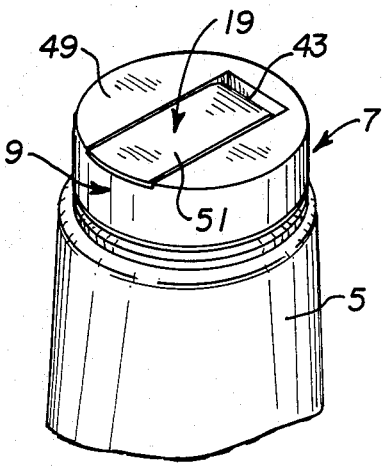
FIG. 6 is a perspective view of a part of the collapsible tube portion and the unit dose dispenser of FIG. 1 showing the closure element in a closed position.

Preferably, the upper surfaces 49 and 51, respectively, of the cap member 9 and the closure element 19 are flush with each other when the closure element 19 is in its closed position (FIG. 6).

The unit dose dispensing collapsible tube 1 can be formed as an extrusion of a flexible plastic material such as polyethylene. Generally the bottom end of such an extrusion is left open, the tube is filled with the viscous liquid 3, and then the bottom edges of the tube are heated and sealed together.

A unit dose of the viscous liquid 3 is dispensed from the unit dose dispensing collapsible tube 1 by first moving the closure element 19 to its open position (FIG. 1). Pressure is applied to the collapsible tube portion 5 to cause the viscous liquid 3 to flow from the collapsible tube portion 5 through the opening 11 in the cap member 9, through the opening 41 in the end surface 43 of the closure element 19, the passageway 39, and the opening 45 in the lower surface 35 of the closure element 19 to the unit dose-measuring section 13 of the cap member 9. When the unit dose-measuring section 13 of the cap member 9 is filled with a unit dose of the viscous liquid 3 (FIG. 5), the closure element 19 is moved to its closed position, as indicated by the arrow in FIG. 5, to dispense the unit dose of the viscous liquid 3 from the unit dose-measuring section 13 of the cap member 9. As the closure element 19 is moved between its open position and its closed position, the lower surface 35 of the closure element 19 gradually abuts the bottom surface 15 of the unit dose-measuring section 13 of the cap member 9, forcing the unit dose of the viscous liquid 3 from the unit dose-measuring section 13 of the cap member 9.

Thus, the invention provides a collapsible tube that is adapted to dispense a unit dose of a viscous liquid 3 therefrom.

I claim:

1. A unit dose dispensing collapsible tube adapted to dispense a viscous liquid therefrom, comprising: a collapsible tube portion adapted to hold a viscous liquid; and a unit dose dispenser comprising:

(a) a cap member on said collapsible tube portion, said cap member having an indentation therein to define a unit dose-measuring section adapted to hold a unit dose of the said viscous liquid, said unit dose-measuring section having an opening therein to provide a path of flow for a said viscous liquid in said collapsible tube portion to said unit dose dispenser, and having a bottom surface; and (b) a closure element connected to said cap member, said closure element having an end surface and a lower surface with a configuration complementary to that of said bottom surface of said unit dose-measuring section of said cap member, said closure element having a passageway therethrough extending from an opening in said end surface to an opening in said lower surface, said closure element being capable of movement between an open position in which said opening in said end surface of said closure element is in fluid flow communication with said opening in said unit dose-measuring section of said cap member and said opening in said lower surface of said closure element is in fluid flow communication with said unit dose-measuring section so that the said viscous liquid can flow from said collapsible tube portion through said passageway to said unit dose-measuring section of said cap member, and a closed position in which said closure element is disposed within said unit dose-measuring section of said cap member, said lower surface of said closure element abuts said bottom surface of said unit dose-measuring section and the said viscous liquid is dispensed from said unit dose-measuring section of said cap member;

whereby a unit dose of the said viscous liquid is dispensed from said unit dose dispensing collapsible tube by moving said closure element to its open position, applying pressure to said collapsible tube portion causing the said viscous liquid to flow from said collapsible tube portion through said passageway in said closure element to said unit dose-measuring section of said cap member, and when said unit dose-measurng section is filled with a unit dose of the said viscous liquid, moving said closure element to its closed position to dispense said unit dose of the said viscous liquid from said unit dose-measuring section of said cap member.

2. The unit dose dispensing collapsible tube of claim 1 wherein said collapsible tube portion and said cap member are formed as a single unit.

3. The unit dose dispensing collapsible tube of claim 1 wherein said cap member and said closure element have upper surfaces that are flush with each other when said closure element is in its closed position.

4. The unit dose dispensing collapsible tube of claim 1 wherein said opening in said lower surface of said closure element is a horizontal slit.

5. The unit dose dispensing collapsible tube of claim 1 wherein said bottom surface of said unit dose-measuring section of said cap member has a centrally disposed raised area and said lower surface of said closure element has a complementary indented area.

6. The unit dose dispensing collapsible tube of claim 1 wherein said closure element is hingedly connected to said cap member.

7. The unit dose dispensing collapsible tube of claim 6 wherein said unit dose-measuring section of said cap member has a pair of side walls and said closure element has a pair of side surfaces, said pairs of side walls and side surfaces being complementary to each other, both of one of said side walls and side surfaces have a projection thereon, and both of the other of said side walls and side surfaces have a complementary indentation therein, whereby said projections are placed within said indentations to hingedly connect said closure element to said cap member.

8. The unit dose dispensing collapsible tube of claim 7 wherein both of said side walls of said unit dose-measuring section of said cap member have a projection thereon, and both of said side surfaces of said closure element have an indentation therein, whereby said projections on said pair of side walls of said cap member are placed within said indentations in said pair of side surfaces of said closure element to hingedly connect said closure element to said cap member.

9. The unit dose dispensing collapsible tube of claim 1 wherein the lowermost edge of said opening in said lower surface of said closure element is coplanar with said upper surface of said cap member when said closure element is in its open position.

10. A unit dose dispenser for a viscous liquid that is held within a collapsible tube comprising: a collapsible tube portion adapted to hold a viscous liquid; and a unit dose dispenser comprising:

(a) a cap member adapted for securement to a collapsible tube having an indentation therein to define a unit dose-measurig section adapted to hold a unit dose of the said viscous liquid, said unit dose-measuring section having an opening therein to provide a path of flow for a said viscous liquid in the said collapsible tube from the said collapsible tube to said unit dose dispenser, and having a bottom surface; and (b) a closure element connected to said cap member, said closure element having an end surface and a lower surface with a configuration complementary to that of said bottom surface of said unit dose-measuring section of said cap member, said closure element having a passageway therethrough extending from an opening in said end surface to an opening in said lower surface, said closure element being capable of movement between an open position in which said opening in said end surface of said closure element is in fluid flow communication with said opening in said unit dose-measuring section of said cap member and said opening in said lower surface of said closure element is in fluid flow communication with said unit dose-measuring section so that the said viscous liquid can flow from said collapsible tube portion through said passageway to said unit dose-measuring section of said cap member, and a closed position in which said closure element is disposed within said unit dose-measuring section of said cap member, said lower surface of said closure element abuts said bottom surface of said unit dose-measuring section and the said viscous liquid is dispensed from said unit dose-measuring section of said cap member;

whereby a unit dose of the said viscous liquid is dispensed from said unit dose dispensing collapsible tube by moving said closure element to its open position, applying pressure to said collapsible tube portion causing the said viscous liquid to flow from said collapsible tube portion through said passageway in said closure element to said unit dose-measuring section of said cap member, and when said unit dose-measuring section is filled with a unit dose of the said viscous liquid, moving said closure element to its closed position to dispense said unit dose of the said viscous liquid from said unit dose-measuring section of said cap member.

11. The unit dose dispenser of claim 10 wherein said cap member and said closure element have upper surfaces that are flush with each other when said closure element is in its closed position.

12. The unit dose dispenser of claim 10 wherein said opening in said lower surface of said closure element is a horizontal slit.

13. The unit dose dispenser of claim 10 wherein said bottom surface of said unit dose-measuring section of said cap member has a centrally disposed raised area and said lower surface of said closure element has a complementary indented area.

14. The unit dose dispenser of claim 10 wherein said closure element is hingedly connected to said cap member.

15. The unit dose dispenser of claim 14 wherein said unit dose-measuring section of said cap member has a pair of side walls and said closure element has a pair of side surfaces, said pairs of side walls and side surfaces being complementary to each other, both of one of said side walls and side surfaces have a projection thereon, and both of the other of said side surfaces have a complementary indentation therein, whereby said projections are placed within said indentations to hingedly connect said closure element to said cap member.

16. The unit dose dispenser of claim 15 wherein both of said side walls of said unit dose-measuring section of said cap member have a projection thereon, and both of said side surfaces of said closure element have an indentation therein, whereby said projections on said pair of side walls of said cap member are placed within said indentations in said pair of side surfaces of said closure element to hingedly connect said closure element to said cap member.

17. The unit dose dispenser of claim 10 wherein the lowermost edge of said opening in said lower surface of said closure element is coplanar with said upper surface of said cap member when said closure element is in its open position.

* * * * *